US009529374B2

(12) United States Patent
Enjalbert et al.

(10) Patent No.: US 9,529,374 B2
(45) Date of Patent: Dec. 27, 2016

(54) LOW DROP-OUT VOLTAGE REGULATOR AND A METHOD OF PROVIDING A REGULATED VOLTAGE

(71) Applicants: Jerome Enjalbert, Fonsorbes (FR); Marianne Maleyran, Saubens (FR); Jalal Ouaddah, Toulouse (FR)

(72) Inventors: Jerome Enjalbert, Fonsorbes (FR); Marianne Maleyran, Saubens (FR); Jalal Ouaddah, Toulouse (FR)

(73) Assignee: NXP USA, Inc., Austin, TX (US)

( * ) Notice: Subject to any disclaimer, the term of this patent is extended or adjusted under 35 U.S.C. 154(b) by 0 days.

(21) Appl. No.: 14/785,679

(22) PCT Filed: Apr. 30, 2013

(86) PCT No.: PCT/IB2013/001173

§ 371 (c)(1),
(2) Date: Oct. 20, 2015

(87) PCT Pub. No.: WO2014/177901

PCT Pub. Date: Nov. 6, 2014

(65) Prior Publication Data

US 2016/0077537 A1 Mar. 17, 2016

(51) Int. Cl.
*G05F 1/30* (2006.01)
*G05F 1/575* (2006.01)

(52) U.S. Cl.
CPC ..... *G05F 1/575* (2013.01)

(58) Field of Classification Search
CPC ..... G05F 1/30; G05F 1/575
USPC ..... 323/271–282
See application file for complete search history.

(56) References Cited

U.S. PATENT DOCUMENTS 6,188,211 B1 * 2/2001 Rincon-Mora ..... G05F 1/575 323/273
7,508,177 B2 * 3/2009 Aiura ..... H02M 1/44 323/268
8,624,568 B2 * 1/2014 Ivanov ..... G05F 1/563 323/274
9,405,309 B2 * 8/2016 Biziitu et al. ..... G05F 1/575
(Continued)

OTHER PUBLICATIONS

International Search Report and Written Opinion correlating to PCT/IB2013/001173 issued on Feb. 13, 2014.

*Primary Examiner* — Adolf Berhane
*Assistant Examiner* — Nusrat Quddus
(74) *Attorney, Agent, or Firm* — Charlene R. Jacobsen

(57) ABSTRACT

A low drop-out voltage regulator, an integrated circuit, a sensor and a method of providing a regulated voltage are provided. The low drop-out voltage regulator comprises a regulated voltage driver for providing the regulated voltage in response to a control voltage, a feedback-loop circuit for generating the control signal such that the regulated voltage driving circuit provides the regulated voltage, and a pull-up circuit for pulling up the regulated voltage to a supply voltage when a difference between the supply voltage and the control voltage is smaller than a predetermined threshold value. In the feedback-loop circuit a first feedback voltage or a second feedback voltage is generated, respectively, on basis of a first ratio and a second ratio between the feedback voltage and the regulated voltage. The second feedback voltage is generated instead of the first feedback voltage when the regulated voltage is pulled-up to the supply voltage.

15 Claims, 4 Drawing Sheets

(56) References Cited

U.S. PATENT DOCUMENTS

| | | | | |
|---|---|---|---|---|
| 2007/0018623 | A1* | 1/2007 | Lopata | G05F 1/575 323/282 |
| 2007/0159146 | A1* | 7/2007 | Mandal | G05F 1/575 323/280 |
| 2008/0116862 | A1* | 5/2008 | Yang | G05F 1/575 323/269 |
| 2011/0193538 | A1* | 8/2011 | Arigliano | G05F 1/563 323/282 |
| 2012/0280667 | A1* | 11/2012 | Drebinger | G05F 1/575 323/273 |
| 2013/0141064 | A1* | 6/2013 | Kay | G05F 1/46 323/271 |

* cited by examiner

LOW DROP-OUT VOLTAGE REGULATOR AND A METHOD OF PROVIDING A REGULATED VOLTAGE

FIELD OF THE INVENTION

This invention relates to the field of low drop-out voltage regulators and methods to provide such a regulated voltage. Low drop-out means that the voltage regulator is still able to deliver the expected regulated voltage when the supply voltage of the voltage regulator drops very close to the expected regulated voltage.

BACKGROUND OF THE INVENTION

Application specific integrated circuits (ASICs), for example, used in sensors, have often a low-power internal voltage regulator to regulate the power supply of circuit blocks that are permanently switched on. Typically two different types of voltage regulators are used which are closed-loop system or open-loop topologies. Each type has specific advantages and disadvantages. For example, closed-loop systems can be designed to have a relatively stable feed-back loop by use of small output capacitor. When the output capacitor of the closed-loop system is relatively small and when the load is switching and is drawing sharp and short spikes from the voltage regulated, the regulated output voltage will be severely disturbed and will gently recover to its regulated value after the load current spikes. This requires a large output decoupling capacitor to smoothen the fast load current spikes. It is necessary that the decoupling capacitor is within the range allowed by the design. The open-loop topologies are less prone to stability issues because a driving transistor that provides the regulated voltage is placed outside the feedback loop, however, the provided regulated voltage by the open-loop voltage regulators is sensitive to the value of the load current.

When, for example, a sensor is provided with such an internal voltage regulator, it is required that the voltage regulator is able to provide a regulated voltage, even when the supply voltage of the voltage regulator becomes very close to the regulated voltage. This is the so-termed low drop-out voltage operational condition and a voltage regulator which is able to correct operate under such an operational condition is termed a low drop-out voltage regulator. When a sensor is provided with, for example, a battery, a low drop-out voltage regulator ensures that the sensor is able to operate as long as possible even when the voltage provided by the battery drops to a level close to the regulated voltage because of exhaustion of the battery.

A known solution for obtaining a low drop-out behavior is the use of pull-up circuits. The function of a pull-up circuits is to prevent that the regulated output voltage drops below a minimum required regulated voltage as the result of a drop of the supply voltage. When the supply voltage becomes close to the minimum required regulated voltage, a pull-up circuit connects the regulated output voltage directly to the supply voltage to obtain a regulated output voltage that is above a minimum required regulated voltage. In open-loop voltage regulators pull-up circuits are also used to pull-up a voltage of a terminal in the internal feedback loop of the voltage regulator. A pull-up circuit is mainly used in open-loop voltage regulators, because in closed-loop regulators the p-type MOS output transistor already acts like a pull-up circuit when the supply voltage drops near the regulated output voltage.

Applying a pull-up circuit in a feed-back loop of an voltage regulator may lead to stability issues, because, at the moments of time of pulling-up and ending the pulling-up, a voltage suddenly changes.

Published US patent application US2007/159146 discloses a low drop-out (LDO) regulator with a stability compensation circuit. A "zero frequency" tracking as well as "non-dominant parasitic poles' frequency reshaping" are performed to achieve a good phase margin for the LDO by means of the compensation circuit. In this compensation method neither a large load capacitor nor its equivalent series resistance is needed to stabilize a regulator. A dominant pole for the regulator is realized at an internal node and the second pole at an output node of the regulator is tracked with a variable capacitor generated zero over a range of load current to cancel the effect of each other. A third pole of the system is pushed out above the unity gain frequency of the open loop transfer function with the help of the frequency compensation circuit.

The cited patent application proposes a variant of the classic Miller compensation for a two stage low drop-out regulator. Thanks to a local feedback within the Miller compensation network, the circuit is more tolerant of variations in load current and load capacitor than conventional topologies. However, since it remains a closed-loop system, the LDO is not unconditionally stable. For very low load current (logic in standby mode) and large load capacitor, the phase margin becomes very poor, unless a minimum sink current (indicated by reference number 518 in FIG. 5 of the cited patent application) is added, which penalizes current consumption. On the other end, for large load current and small load capacitor, a complex pair of poles appear in the transfer function, which again jeopardizes the stability. In conclusion, the published patent application provides some more stability in a closed-loop voltage regulator, but still specific stability issues remain.

SUMMARY OF THE INVENTION

The present invention provides a low drop-out voltage regulator, an integrated circuit, a sensor device and a method of providing a regulated voltage as described in the accompanying claims.

Specific embodiments of the invention are set forth in the dependent claims.

These and other aspects of the invention will be apparent from and elucidated with reference to the embodiments described hereinafter.

BRIEF DESCRIPTION OF THE DRAWINGS

Further details, aspects and embodiments of the invention will be described, by way of example only, with reference to the drawings. Elements in the figures are illustrated for simplicity and clarity and have not necessarily been drawn to scale.

Elements in the figures are illustrated for simplicity and clarity and have not necessarily been drawn to scale. In the Figures, elements which correspond to elements already described may have the same reference numerals.

DETAILED DESCRIPTION OF THE PREFERRED EMBODIMENTS

Figure 1:
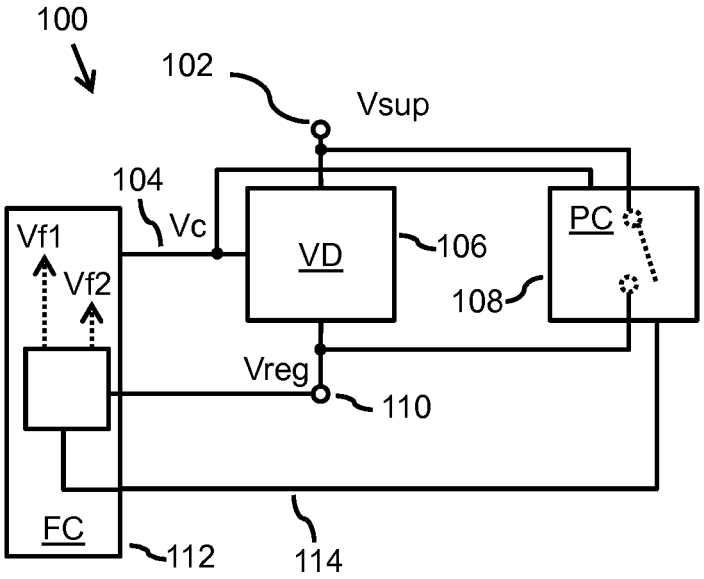
FIG. 1 schematically shows an example of an embodiment of a low drop-out voltage regulator, FIG. 2 schematically show another example of a low drop-out voltage regulator, FIG. 3 schematically shows a further example of a low drop-out voltage regulator, FIG. 4 schematically shows an example of a method of providing a regulated voltage.

FIG. 1 schematically shows an example of an embodiment of a low drop-out voltage regulator 100 for providing a regulated voltage Vreg. The low drop-out voltage regulator comprises a supply voltage terminal 102 for receiving a supply voltage Vsup, a regulated voltage terminal 110 for providing the regulated voltage Vreg, a regulated voltage driver 106, VD, a feedback-loop circuit 112, FC, and a pull-up circuit 108, PC. The regulated voltage driver 106, VD provides the regulated voltage to the regulated voltage terminal 110 in response receiving a control voltage 104, Vc. The feedback-loop circuit 112, FC generates the control voltage 104, Vc such that the regulated voltage driving circuit 106, VD provides the regulated voltage Vreg. In the feedback-loop circuit 112, FC a first feedback voltage Vf1 is generated which relates to the value of the regulated voltage Vreg on basis of a first ratio between the first feedback voltage Vf1 and the regulated voltage Vreg. The pull-up circuit 108, PC pulls the regulated voltage Vreg up to the supply voltage Vsup when a difference between the supply voltage Vsup and the control voltage 104 is smaller than a predefined voltage difference. The pull-up circuit 108 PC also provides a pull-up signal 114 to the feedback-loop circuit 112, FC when the regulated voltage Vreg is pulled up to the supply voltage Vsup. The feedback-loop circuit 112, FC generates, when it receives the pull-up signal 114, a second feedback voltage Vf2 instead of the first feedback voltage Vf1. The second feedback voltage Vf2 is generated on basis of a second ratio between the second feedback voltage Vf2 and the regulated voltage Vreg. The second ratio is different from the first ratio. The second ratio is chosen such that it prevents oscillations in the low drop-out voltage regulator. Within the feedback-loop circuit 112, FC, the control voltage 104, Vc is generated on basis of the generated feedback voltage Vf1, Vf2.

Oscillations of, for example, the regulated voltage Vreg or an oscillating pull-up circuit 108, PC may be the result of changing voltages in the feedback-loop circuit 112, FC such that the control voltage 104 drops too much resulting in an end of the pulling-up of the regulated voltage Vreg to the supply voltage Vsup. When the pull-up circuit 108, PC pulls up the regulated voltage Vreg to the supply voltage Vsup, the regulated voltage Vreg suddenly increases. If the second feedback voltage Vf2 is not generated and only the first feedback voltage Vf1 is used in the feedback-loop of the feedback-loop circuit 112, FC, the control voltage 104 may suddenly drop and the difference between the control voltage 104 and the supply voltage Vsup may become larger than the predefined voltage difference. This results in a ending the pulling-up of the regulated voltage Vreg to the supply voltage Vsup, which results in a sudden drop of the regulated voltage Vreg and a sudden increase in the control voltage 104, Vc, which may subsequently result in pulling up the regulated voltage Vreg to the supply voltage Vsup. Etc.

The pull-up signal 114 is drawn as an electrical coupling between the pull-up circuit 108, PC and the feedback-loop circuit 112, FC. Thee pull-up signal 114 may have different values and one of the values may transport the information that the regulated voltage Vreg is pulled up to the supply voltage Vsup. For example, the pull-up signal 114 may be 0 when the regulated voltage Vreg is not pulled up to the supply voltage Vsup and the pull-up signal 114 may be 1 when the regulated voltage Vreg is pulled up to the supply voltage Vsup.

Within the feedback-loop circuit 112, FC is drawn a box which generates the first feedback voltage Vf1 or the second feedback voltage Vf2 on basis of a received regulated voltage Vreg. The provided pull-up signal is used to generate the second feedback voltage Vf2 when the regulated voltage Vreg is pulled-up to the supply voltage Vsup. An embodiment of a circuit that generates the feedback voltages Vf1, Vf2 is discussed in the context of FIG. 2 and FIG. 3.

The low drop-out voltage regulator 100 may be implemented on an integrated circuit which is manufactured on a semiconductor material. In another embodiment, different elements of the low drop-out voltage regulator 100 may be implemented on separate integrated circuits or integrated circuits may be combined with separate electronic components (such as, for example, a driving transistor). The low drop-out voltage regulator 100 may also be provided in a sensor device for providing power to circuit blocks that are permanently switched on.

Figure 2:
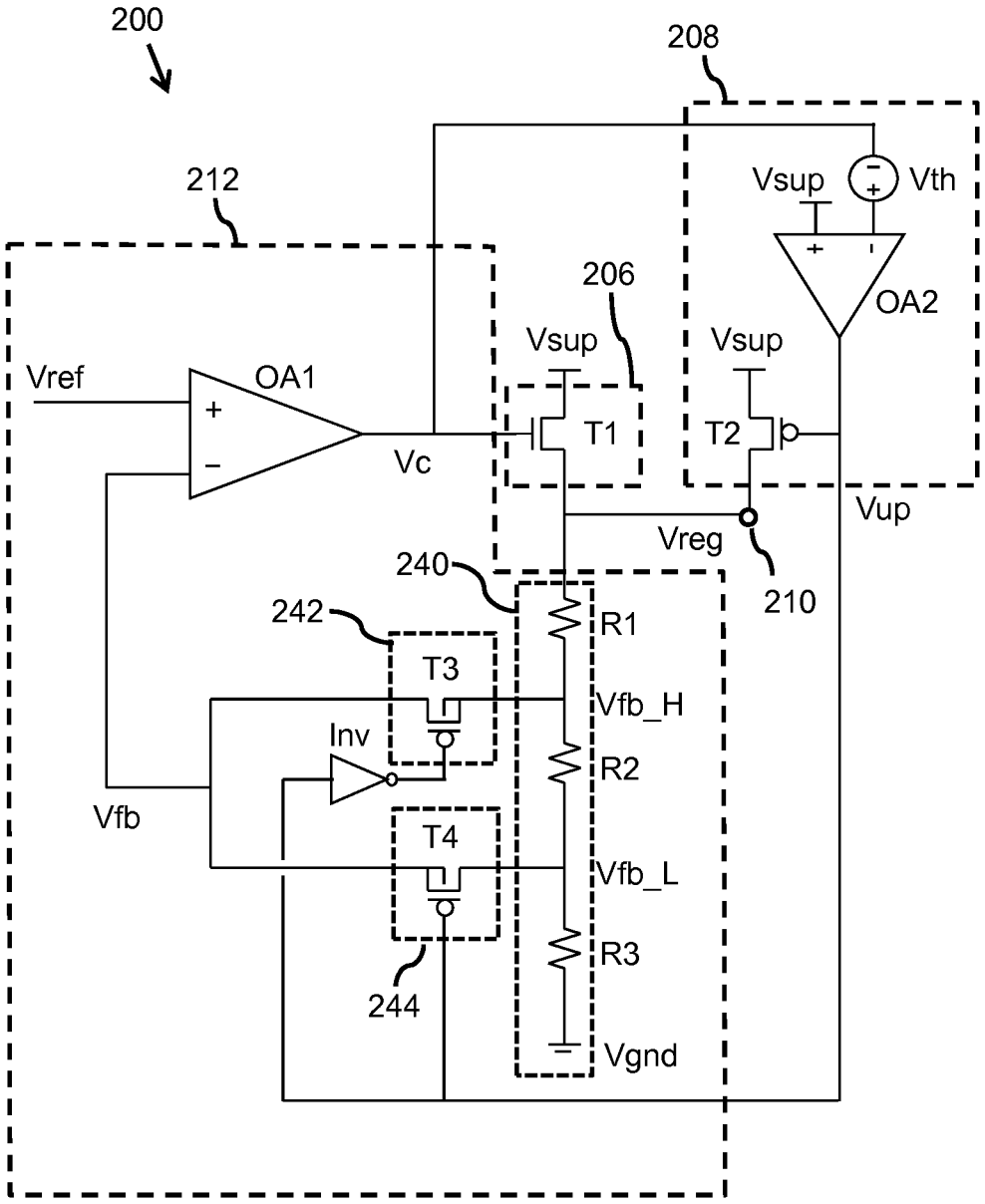

FIG. 2 schematically show another example of a low drop-out voltage regulator 200. The topology of the low-drop out voltage regulator 200 is a closed-loop topology because the regulated voltage terminal 210 is also the output terminal of the regulated voltage Vreg and the regulated voltage terminal 210 is a terminal that is within a feedback-loop of the circuit. The presented low drop-out regulator 200 may be manufactured on an integrated circuit and/or may be a circuit of a sensor device for providing a regulated voltage to other circuits of the integrated circuit or of the sensor device.

The low drop-out voltage regulator 200 comprises supply voltage terminals Vsup, a ground voltage terminal Vgnd, the regulated voltage terminal 210 which also outputs the regulated voltage Vreg, a regulated voltage driver 206, a feedback-loop circuit 212, and a pull-up circuit 208.

The regulated voltage driver 206 comprises a n-type MOS transistor T1. A current conduction path of the MOS transistor T1 is coupled between the supply voltage Vsup and the regulated voltage terminal 210. A gate of the MOS transistor T1 is coupled to a control voltage Vc. The use of an n-type MOS transistor T1 has as the advantage that the output of the low drop-out voltage regulator (provided at the regulated voltage terminal 210) has a low output impedance.

The pull-up circuit 208 comprises a second opamp (operational amplifier) OA2 which receives at a plus input port the supply voltage Vsup and which receives at the minus input port the control voltage Vc plus a predetermined voltage Vth. The second opamp OA2 operates as an comparator. In FIG. 2, the pull-up circuit 208 comprises in between the control voltage Vc and the minus input port of the second opamp OA2 a voltage source which provides the predetermined voltage Vth. The voltage source is coupled such that the minus input port of the second operational amplifier OA2 receives the voltage Vc+Vth. The predetermined voltage Vth is related to characteristics of the MOS transistor T1: Vth relates to the voltage drop across T1 when the supply voltage Vsup drops too much such that the provided voltage regulated voltage Vreg becomes below the required regulated voltage. In a practical embodiment, the voltage source is a build-in offset voltage in the second opamp OA2. Normally, the input stage of an opamp/a comparator is built around an input differential pair where the 2 transistors are identical (each of the negative and positive inputs of the comparator connect to the gate of one of these transistors) resulting in a built-in offset voltage of zero: the opamp trip point (switching point) occurs when positive input voltage and negative input voltage are equal. To generate a non-zero offset voltage, different sizes for the 2 transistors of the differential pair.

In this configuration, the second opamp OA2 provides a low signal (substantially equal to the ground voltage) when a voltage difference between the supply voltage Vsup and the control voltage Vc is below the predefined voltage Vth and provides a high signal (substantially equal to the supply voltage Vsup) otherwise. Thus, Vup=0 when Vsup<Vc+Vth, and Vup=Vsup when Vsup>Vc+Vth. This output voltage of the second operational amplifier OA2 is a pull-up voltage Vup. This pull-up voltage Vup is, when its value is substantially equal to the ground voltage ("low" or "0"), the pull-up signal of FIG. 1. The pull-up voltage Vup is coupled to a gate of a p-type MOS transistor T2 which is coupled with its current conduction path between the supply voltage Vsup and the regulated voltage terminal 210. When the pull-up voltage is low, the voltage of the regulated voltage terminal 210 is pulled up to the supply voltage Vsup via the current conduction path of the MOS transistor T2. The pull-up voltage Vup is also provided to the feedback-loop circuit 212. An advantage of the use of a p-type MOS transistor T2 is that, when MOS transistor T2 is in the conducting state, the voltage drop across the MOS transistor T2 is relatively small.

The feedback-loop circuit 212 comprises a first opamp (operational amplifier) OA1 which is coupled with a plus input port to a reference voltage Vref. The reference voltage Vref relates to the required level of the regulated voltage Vreg and its value depends on an expected feedback voltage Vfb when the voltage of the regulated voltage terminal is exactly equal to the required regulated voltage. The feedback-lop circuit 212 generates a feedback voltage Vfb which is provided to the minus input port of the first opamp OA1. In an embodiment, the first opamp OA1 is an Operational Transconductance Amplifier.

The feedback-loop circuit 212 comprises a series arrangement 240 of resistors R1, R2 and R3. The first resistor R1 is coupled between the regulated voltage terminal 210 and a high feedback voltage terminal Vfb_H. The second resistor R2 is coupled between the high feedback voltage terminal Vfb_H and a low feedback voltage terminal Vfb_L. The third resistor R3 is coupled between the low feedback voltage terminal Vfb_L and the ground voltage Vgnd. The series arrangement 240 generates a high feedback voltage Vfb_H which directly relates to the regulated voltage of the regulated voltage terminal 210 according to a first ratio $$\frac{R2+R3}{R1+R2+R3}$$

and generates a low feedback voltage Vfb_L which directly relates to the regulated voltage of the regulated voltage terminal 210 according to the second ratio $$\frac{R3}{R1+R2+R3}.$$

Consequently, me second ratio is smaller than the first ratio.

The feedback-loop circuit 212 comprises two p-type MOS transistors T3 and T4 which are both coupled to the feedback voltage Vfb at one end and with the other end to, respectively, the high feedback voltage terminal Vfb_H and the low feedback voltage terminal Vfb_L. The gate of the MOS transistor T4 is coupled to the pull-up voltage Vup and the gate of the MOS transistor T3 is coupled to an output of an inverter which inverts the pull-up voltage Vup. Thus, when the pull-up voltage is high (which is when the voltage of the regulated voltage terminal 210 is not pulled-up to the supply voltage Vsup), MOS transistor T3 is in the conducting state (and T4 not) and couples the high feedback voltage Vfb_H to the feedback voltage Vfb, and, thus, to the minus input port of the first opamp OA1. When the pull-up voltage Vup indicates that the voltage of the regulated voltage terminal is pulled-up to the supply voltage Vsup (thus, when Vup is low), the MOS transistor T4 is in the conducting state (and T3 not) and couples the low feedback voltage Vfb_L to the feedback voltage Vfb. The MOS transistor T3 and T4 have their bulk, as indicated in the drawing, coupled to a terminal at which the highest voltage may be expected (this to prevent that the MOS transistor T3 or T4 may start to operate as a diode). It is to be noted that MOS transistors T3 and T4 are embodiments of controllable switches. In FIG. 2, the controllable switches 242, 244 are schematically drawn by a box around the MOS transistors T3 and T4.

When the low drop-out voltage regulator is not operating under a pull-up condition, the high feedback voltage Vfb_H is provided to the first opamp OA1. When the high feedback voltage Vfb_H is higher than the reference voltage Vreg, the control voltage reduces and, consequently, the regulated voltage provided to the regulated voltage terminal 210 reduces, and vice versa. As discussed previously, this may lead to oscillations when the pull-up circuit 208 pulls-up the voltage of the regulated voltage terminal 210 to the supply voltage Vsup. In particular, when the pull-up circuit 208 controls MOS transistor T2 in the conducting mode, the feedback voltage Vfb may rise too much. Therefore, when the pull-up circuit controls the MOS transistor T2 in the conducting mode, the feedback voltage that is provided to the first opamp OA1 is reduced by providing the low feedback voltage Vfb_L to the minus input port of the opamp OA1.

When MOS transistor T2 is not in the conducting state, thus, pull-up is not enabled, the feedback voltage is defined by $$V_{fb1} = \frac{R2+R3}{R1+R2+R3} V_{reg}. \tag{1}$$

When MOS transistor T2 is in the conducting state, thus, pull-up is enabled, the feedback voltage is defined by:

$$V_{fb2} = \frac{R3}{R1+R2+R3} V_{sup}$$

(2). The pull-up is enabled at a particular maximum supply voltage, which is indicated by $v_{sup\text{-}pull\text{-}up}^{max}$. At the moment when pull-up is enabled, the feedback voltage is:

$$V_{fb2} = \frac{R3}{R1+R2+R3} V_{supp-pull-up}^{max}. \tag{3}$$

At this pulling-up moment, the feedback voltage $V_{fb2}$ should be smaller than the feedback voltage $V_{fb1}$ just before the pulling-up moment to prevent oscillations. Thus, $V_{fb2}<V_{fb1}$ (4). By combining formula (4) with formula (1) and formula (3), a maximum value for resistor R3 may be calculated:

$$R3 < R2\frac{V_{reg}}{V_{sup-pull-up}^{max} - V_{reg}}.$$

In this formula, $V_{reg}$ is the required regulated voltage. As discussed earlier, the value for $v_{sup-pull-up}^{max}$ depends on characteristics of the MOS transistor T1 and is actually determined by the maximum gate source voltage $V_{gs}$ of this MOS transistor T1: $v_{sup-pull-up}^{max}=V_{reg}+V_{gsT1}^{max}$ It can be shown that the supply voltage at which the pulling-up is disabled (MOS transistor T2 is controlled into the non-conducting mode) at the subsequent supply voltage $$V_{sup} = \frac{R1 + R2 + R3}{R3}V_{ref}.$$

Thus, by carefully choosing resistances for the resistors R1, R2 and R3 some hysteresis may be introduced such that a very predictable transition is achieved without oscillations. Thus, the system is stable because it switches from pulling-up ON to puling-up OFF in a smooth and clean way without oscillations.

Figure 3:
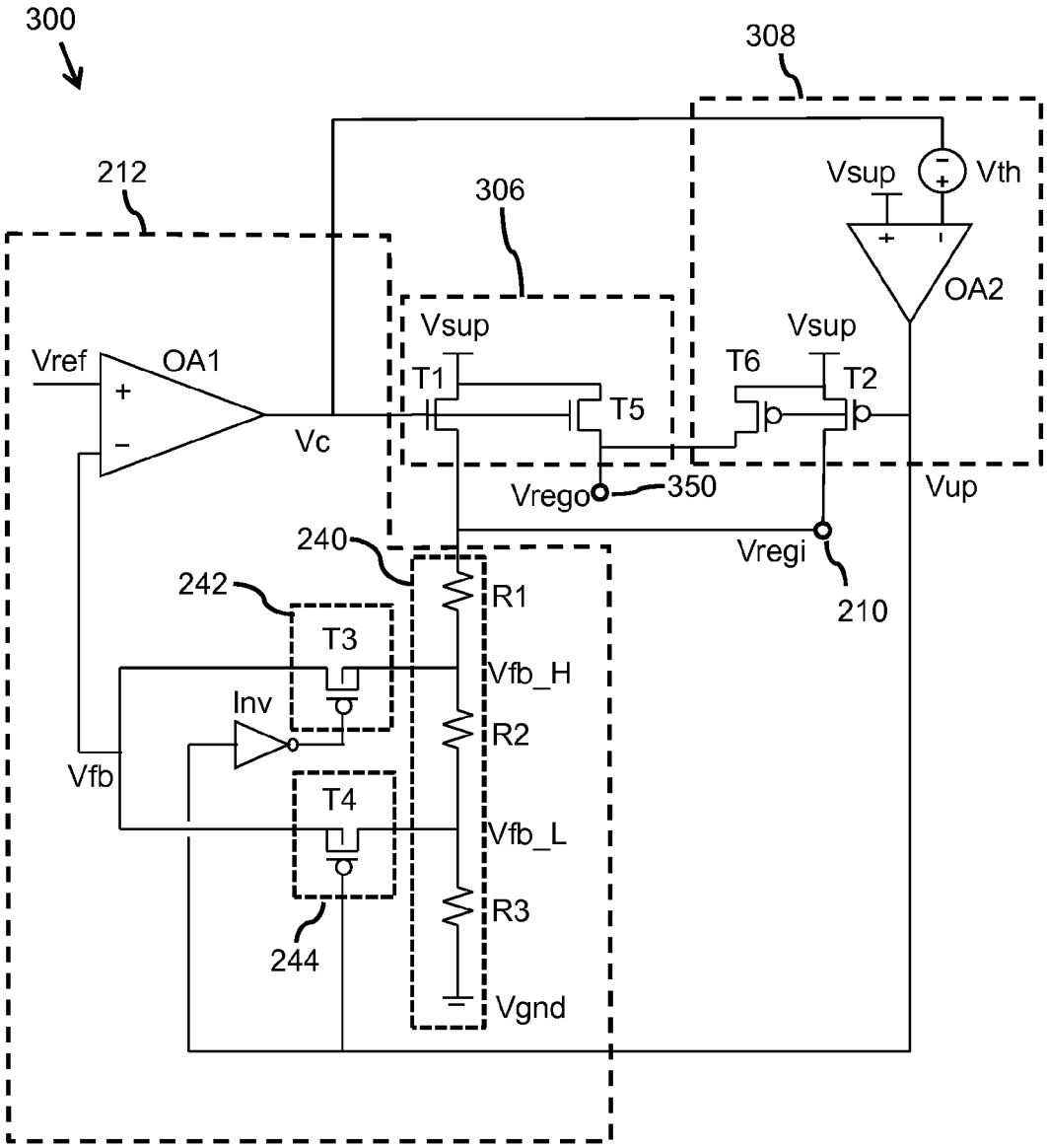

FIG. 3 schematically shows a further example of a low drop-out voltage regulator 300. Low drop-out voltage regulator 300 is similar to low drop-out voltage regulator 200 of FIG. 2 with a minor difference. Low drop-out voltage regulator 200 of FIG. 2 is a so-termed closed-loop regulator because the provided regulated output voltage is directly obtained from a terminal in the feedback-loop of the voltage regulator. Low drop-out voltage regulator 300 of FIG. 3 is a so-termed open-loop regulator because the obtained regulated output voltage is not directly provided by an electrical component that is within the feedback-loop. In the low-drop-out voltage regulator 300 the regulated voltage terminal 210 has the voltage of an internal regulated voltage Vregi and another embodiment of a regulated voltage driver 306 is provided. The regulated voltage driver 306 has also an n-type MOS transistor T1 which is within the feedback-loop and provides the internal regulated voltage Vregi to the regulated voltage terminal 210. The regulated voltage driver 306 also comprises a further n-type MOS transistor T5 which provides the regulated output voltage Vrego to the regulated output voltage terminal 350. The current conduction path of MOS transistor T5 is coupled between the supply voltage and the regulated output voltage terminal 350. The gate of MOS transistor T5 is also coupled to the control voltage. MOS transistors T1 and T5 must be of a similar type and design and only their sizes may differ. A ratio between a size of MOS transistor T1 and MOS transistor T5 must have value that is relatively close to a ratio between an expected current through MOS transistor T1 and an expected current through MOS transistor T5—if this condition is fulfilled, the regulated output voltage Vrego will be almost equal to the internal regulated voltage Vregi. If, for example, the current provided to the load of the low drop-out voltage regulator varies, the regulated output voltage Vrego will vary too. Thus, in the above discussed embodiment, the internal regulated voltage Vregi of the regulated voltage terminal 210 is well regulated, but the regulated output voltage Vrego may show more variations in its value than the internal regulated voltage Vregi. When the current drawn from the regulated output voltage terminal 350 is continuously and substantially equal to the (predicted) value that has been used during the design of the low drop-out voltage regulator 300, the regulated output voltage Vrego is well regulated as well. The low drop-out voltage regulator 300 of FIG. 3 is also different from the low drop-out voltage regulator 200 of FIG. 2 with respect to its pull-up circuit 308. The pull-up circuit 308 comprises an additional p-type MOS transistor T6 which is coupled in parallel to the transistor T2 for pulling up the regulated output voltage Vrego to the supply voltage when the difference between the control voltage Vc and the supply voltage is smaller than the predetermined voltage difference Vth.

Figure 4:
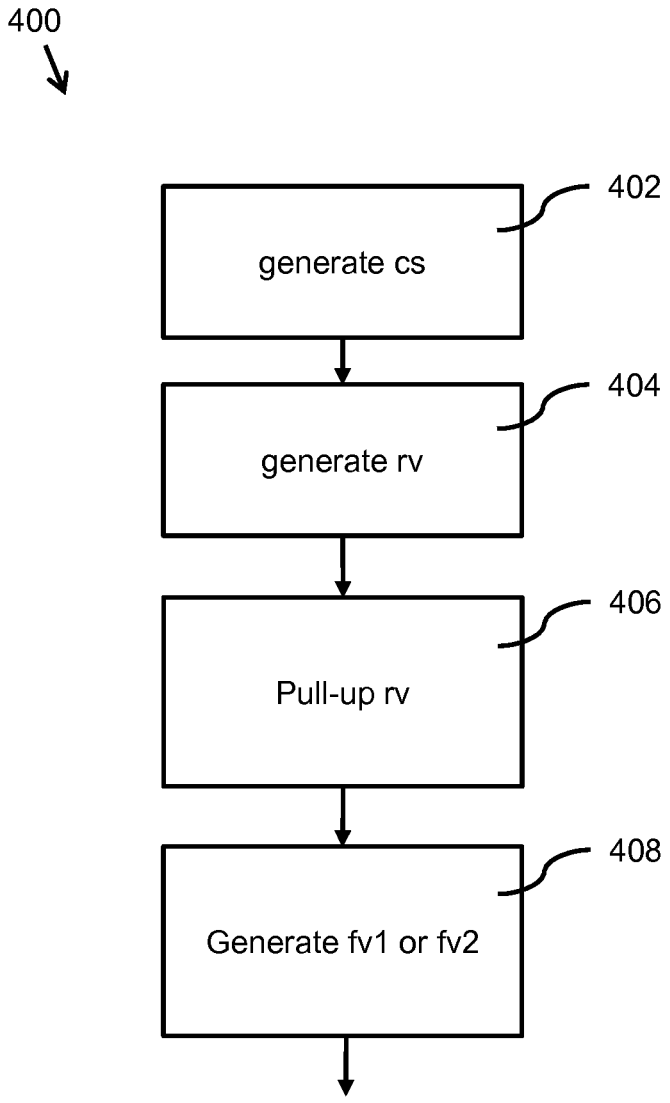

FIG. 4 schematically shows an example of a method 400 of providing a regulated voltage. The method comprises the stages of: i) generating 402 a control voltage by a feedback-loop circuit for controlling a regulated voltage driver that provides the regulated voltage, ii) generating 404 the regulated voltage by the regulated voltage driver in dependence of the control voltage, iii) pulling-up 406 the regulated voltage to a supply voltage when a difference between a supply voltage and the control voltage is smaller than predefined voltage difference, iv) generating 408 in the feedback-loop circuit a first feedback voltage or a second feedback voltage which relate to the regulated voltage on basis of a first ratio or on basis of a second ratio, wherein the first ratio is different from the second ratio and wherein the first feedback voltage is generated on basis of the first ratio when the regulated voltage is not pulled-up to the supply voltage and the second feedback voltage is generated on basis of the second ratio when the regulated voltage is pulled-up to the supply voltage, the first ratio and the second ratio being defined by, respectively, the first feedback voltage or the second feedback voltage divided by the regulated voltage.

In summary, a low drop-out voltage regulator, an integrated circuit, a sensor and a method of providing a regulated voltage are provided. The low drop-out voltage regulator comprises a regulated voltage driver for providing the regulated voltage in response to a control voltage, a feedback-loop circuit for generating the control signal such that the regulated voltage driving circuit provides the regulated voltage, and a pull-up circuit for pulling up the regulated voltage to a supply voltage when a difference between the supply voltage and the control voltage is smaller than a predetermined threshold value. In the feedback-loop circuit a first feedback voltage or a second feedback voltage is generated, respectively, on basis of a first ratio and a second ratio between the feedback voltage and the regulated voltage. The second feedback voltage is generated instead of the first feedback voltage when the regulated voltage is pulled-up to the supply voltage.

In the foregoing specification, the invention has been described with reference to specific examples of embodiments of the invention. It will, however, be evident that various modifications and changes may be made therein without departing from the broader spirit and scope of the invention as set forth in the appended claims. For example, the connections may be any type of connection suitable to transfer signals from or to the respective nodes, units or devices, for example via intermediate devices. Accordingly, unless implied or stated otherwise the connections may for example be direct connections or indirect connections.

The integrated circuit is manufactured on a semiconductor substrate. The semiconductor substrate can be any semiconductor material or combinations of materials, such as gallium arsenide, silicon germanium, silicon-on-insulator (SOI), silicon, monocrystalline silicon, the like, and combinations of the above.

Each signal described herein may be designed as positive or negative logic, where negative logic can be indicated by a bar over the signal name or an asterix (*) following the name. In the case of a negative logic signal, the signal is active low where the logically true state corresponds to a logic level zero. In the case of a positive logic signal, the signal is active high where the logically true state corresponds to a logic level one. Note that any of the signals described herein can be designed as either negative or positive logic signals. Therefore, in alternate embodiments, those signals described as positive logic signals may be implemented as negative logic signals, and those signals described as negative logic signals may be implemented as positive logic signals.

The conductors as discussed herein, or the conductors that conduct the discussed signals, may be illustrated or described in reference to being a single conductor, a plurality of conductors, unidirectional conductors, or bidirectional conductors. However, different embodiments may vary the implementation of the conductors. For example, separate unidirectional conductors may be used rather than bidirectional conductors and vice versa. Also, plurality of conductors may be replaced with a single conductor that transfers multiple signals serially or in a time multiplexed manner. Likewise, single conductors carrying multiple signals may be separated out into various different conductors carrying subsets of these signals. Therefore, many options exist for transferring signals.

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

Although the invention has been described with respect to specific conductivity types or polarity of potentials, skilled artisans appreciated that conductivity types and polarities of potentials may be reversed.

Of course, the description of the architecture has been simplified for purposes of discussion, and it is just one of many different types of appropriate architectures that may be used in accordance with the invention. Those skilled in the art will recognize that the boundaries between logic blocks are merely illustrative and that alternative embodiments may merge logic blocks or circuit elements or impose an alternate decomposition of functionality upon various logic blocks or circuit elements.

Thus, it is to be understood that the architectures depicted herein are merely exemplary, and that in fact many other architectures can be implemented which achieve the same functionality. In an abstract, but still definite sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Also for example, in one embodiment, the illustrated elements of the low drop-out voltage regulator are circuitry located on a single integrated circuit or within a same device. Alternatively, low drop-out voltage regulator may include any number of separate integrated circuits or separate devices interconnected with each other.

Furthermore, those skilled in the art will recognize that boundaries between the functionality of the above described operations merely illustrative. The functionality of multiple operations may be combined into a single operation, and/or the functionality of a single operation may be distributed in additional operations. Moreover, alternative embodiments may include multiple instances of a particular operation, and the order of operations may be altered in various other embodiments.

Also, devices functionally forming separate devices may be integrated in a single physical device. Also, the units and circuits may be suitably combined in one or more semiconductor devices.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

The invention claimed is:

1. A low drop-out voltage regulator for providing a regulated voltage, the low drop-out voltage regulator comprises a supply voltage terminal for receiving a supply voltage;

a regulated voltage terminal for providing the regulated voltage;

a regulated voltage driver for providing the regulated voltage to the regulated voltage terminal in response to a control voltage;

a feedback-loop circuit for generating the control voltage on basis of a feedback voltage such that the regulated voltage driver provides the regulated voltage wherein, in the feedback-loop circuit, a first feedback voltage is generated which relates to the value of the regulated voltage on basis of a first ratio between the first feedback voltage and the regulated voltage;

a pull-up circuit for pulling the regulated voltage up to the supply voltage when a difference between the supply voltage and the control voltage is smaller than a predefined voltage difference, wherein the pull-up circuit is configured to provide a pull-up signal to the feedback-loop circuit when the regulated voltage is pulled up to the supply voltage, and the feedback-loop circuit is configured to generate a second feedback voltage instead of the first feedback voltage when it receives the pull-up signal the second feedback voltage is generated on basis of a second ratio between the second feedback voltage and the regulated voltage, the second ratio is different from the first ratio and the second ratio is for preventing oscillations in the low drop-out voltage regulator.

2. A low drop-out voltage regulator according to claim 1, wherein the first ratio is larger than the second ratio.

3. A low drop-out voltage regulator according to claim 1, wherein the first feedback voltage and the second feedback voltage directly relate to a voltage of the regulated voltage terminal according to, respectively, the first ratio and the second ratio.

4. A low drop-out voltage regulator according to claim 3, wherein a terminal of the feedback-loop circuit is coupled to the regulated voltage terminal for generating the first feedback voltage and the second feedback voltage.

5. A low drop-out voltage regulator according to claim 1, wherein the feedback-loop circuit comprises a first operational amplifier for comparing a reference voltage coupled to the plus input port with the feedback voltage coupled to the minus input port, wherein the first operational amplifier generates the control voltage.

6. A low drop-out voltage regulator according to claim 1, wherein the regulated voltage driver comprises a driving transistor being coupled between the supply voltage and the regulated voltage terminal, a gate of the driving transistor receives the control voltage.

7. A low drop-out voltage regulator according to claim 1, wherein the feedback-loop circuit comprises a series arrangement of a first resistor, a second resistor and a third resistor, the first resistor being coupled to the regulated voltage terminal and the third resistor being coupled to a ground voltage, the first feedback voltage according to the first ratio is present at a terminal shared by the first resistor and the second resistor and the second feedback voltage according to the second ratio is present at a terminal shared by the second resistor and the third resistor.

8. A low drop-out voltage regulator according to claim 7, wherein the feedback-loop circuit comprises a first controllable switch and a second controllable switch, a first terminal of the first controllable switch is coupled to the terminal shared by the first resistor and the second resistor and a second terminal of the first controllable switch is coupled to a feedback terminal that provides the feedback voltage, a first terminal of the second controllable switch is coupled to the terminal shared by the second resistor and the third resistor and a second terminal of the second controllable switch is also coupled to the feedback terminal, wherein the feedback-loop circuit is configured to control the first controllable switch in a conducting mode and to control the second controllable switch in a non-conducting mode when no pull-up signal is received, and feedback-loop circuit is configured to control the first controllable switch in a non-conducting mode and to control the second controllable switch in a conducting mode when the pull-up signal is received.

9. A low drop-out voltage regulator according to claim 8, wherein the first controllable switch and the second controllable switch are, respectively, a first transistor and a second transistors and the pull-up signal is provided directly to a gate of the second transistor and an inverted pull-up signal is provided to a gate of the first transistor.

10. A low drop-out voltage regulator according to claim 7, wherein the second resistor has a second resistance R2, the third resistor has a third resistance R3 and $$R3 < R2\frac{V_{sup}}{Vsup_{pull-up-sustfed}^{max} - V_{reg}},$$

wherein $V_{reg}$ is the required regulated voltage and $Vsup_{pull\text{-}up\ enabled}^{max}$ is the maximum supply voltage at which it can occur that the pull-up circuit pulls the regulated voltage up to the supply voltage.

11. A low drop-out voltage regulator according to claim 1, wherein the low drop-out voltage regulator is an open-loop voltage regulator and comprises an regulated output voltage terminal, wherein the regulated voltage driver generates the regulated voltage of the regulated voltage terminal and generates an regulated output voltage at the regulated output voltage terminal on basis of the control voltage.

12. A low drop-out voltage regulator according to claim 11, wherein the regulated voltage driver comprises an internal regulated voltage transistor and an output regulated voltage transistor, the internal regulated voltage transistor being coupled between the supply voltage and the regulated voltage terminal for providing the regulated voltage to the regulated voltage terminal, a gate of the internal regulated voltage transistor receives the control voltage, the output regulated voltage transistor being coupled between the supply voltage and the regulated output voltage terminal for providing the regulated output voltage, a gate of the output regulated voltage transistor receives the control voltage.

13. A low drop-out voltage regulator according to claim 1, wherein the low drop-out voltage regulator is a closed-loop voltage regulator wherein a regulated output voltage of the low drop-out voltage regulated is provided by the regulated voltage terminal.

14. A low drop-out voltage regulator according to claim 1, wherein the pull-up circuit comprises a second operational amplifier for generating the pull-up signal, the plus input port of the second operational amplifier is coupled to the supply voltage and the minus input port of the second operational amplifier is coupled to the control voltage, wherein the second operational amplifier has a build-in offset voltage being substantially equal to the predefined voltage difference.

15. A method of providing a regulated voltage, the method comprises:

generating a control voltage by a feedback-loop circuit for controlling a regulated voltage driver that provides the regulated voltage;

generating the regulated voltage by the regulated voltage driver in dependence of the control voltage;

pulling-up the regulated voltage to a supply voltage when a difference between the supply voltage and the control voltage is smaller than predefined voltage difference;

generating in the feedback-loop circuit a first feedback voltage or a second feedback voltage which relate to the regulated voltage on basis of a first ratio between the first feedback voltage and the regulated voltage or on basis of a second ratio between the second feedback voltage and the regulated voltage, wherein the first ratio is different from the second ratio and wherein the first feedback voltage is generated on basis of the first ratio when the regulated voltage is not pulled-up to the supply voltage and the second feedback voltage is generated on basis of the second ratio when the regulated voltage is pulled-up to the supply voltage.

* * * * *